US008167311B1

(12) United States Patent
Wang

(10) Patent No.: US 8,167,311 B1
(45) Date of Patent: May 1, 2012

(54) GAME MACHINE

(75) Inventor: Chih-Chieh Wang, Taichung (TW)

(73) Assignee: Youal-Jifh Enterprise Co., Ltd., Xitun District, Taichung (TW)

( * ) Notice: Subject to any disclaimer, the term of this patent is extended or adjusted under 35 U.S.C. 154(b) by 0 days.

(21) Appl. No.: 13/010,781

(22) Filed: Jan. 21, 2011

(51) Int. Cl.
*A63F 9/00* (2006.01)

(52) U.S. Cl. ..... 273/451; 273/447; 273/459; 273/460

(58) Field of Classification Search ..... 273/440, 273/447, 448, 451, 454, 459, 460
See application file for complete search history.

(56) References Cited

U.S. PATENT DOCUMENTS 6,315,157 B1 * 11/2001 Halliburton ..... 221/87
7,600,760 B2 * 10/2009 Matsuda et al. ..... 273/447
8,016,292 B1 * 9/2011 Yang et al. ..... 273/451
8,079,597 B1 * 12/2011 Wei ..... 273/451

* cited by examiner

*Primary Examiner* — Raleigh W. Chiu

(57) ABSTRACT

A game machine includes a cabinet-type main frame. A rack and a movement assembly respectively mounted in the main frame. The rack has multiple rooms defined therein for receiving prizes. An operational unit is mounted on a front panel of the main frame for user to operate the movement assembly. A drive device is mounted on the movement assembly and reciprocally moved relative to the rack. Multiple driven devices are mounted on the rack. Each driven device aligns with a corresponding one of the rooms. Each driven device has a shaft extending into the corresponding room and reciprocally moved to push a prized received in the room when the drive device is engaged to and pushes the shaft.

12 Claims, 7 Drawing Sheets

GAME MACHINE

BACKGROUND OF THE INVENTION

1. Field of the Invention

The present invention relates to a game machine, and more particularly to a game machine that includes a movement assembly indirectly pushing the prize received in the game machine.

2. Description of Related Art

A conventional cabinet-type game machine, such as a doll catch machine, is popular in an amusement park. The doll catch machine, for example, has a catcher that is firstly moved along an X-axis and a Y-axis above the dolls. Secondly, the catcher is moved along a Z-axis to catch the aligned doll. Lastly, the caught doll falls into a passage and the player can get the doll as a reward from the passage.

However, the suspensory game machine has been popular for a long time and becomes bored to the consumers. The types of dolls are often changed, but few consumers want to try again. Consequently, the play ways of the suspensory game machine need to be advantageously altered.

The present invention has arisen to mitigate and/or obviate the disadvantages of the conventional suspensory game machine.

SUMMARY OF THE INVENTION

The main objective of the present invention is to provide an improved game machine that includes a movement assembly indirectly pushing the prize received in the game machine.

To achieve the objective, the game machine in accordance with the present invention comprises a cabinet-type main frame standing on a supporting surface and including a partition horizontally secured therein. A passage is defined in the partition. A prize dispensing hole is defined in a front panel of the main frame and communicates with the passage. A rack is vertically mounted on the partition front of the passage. The rack has multiple rooms defined therein for receiving prizes and a transparent panel attached to a front side of the rack for closing the rooms. A movement assembly is mounted on the partition and a drive device is mounted on the movement assembly, wherein the movement assembly drives the drive device along a plane that is parallel to the transparent panel. The drive device includes a seat mounted on the movement assembly and a pair of rails formed on the seat toward the transparent panel. A slider is slidably mounted on the pair of rails. A coupling and drive unit are respectively mounted on the slider and connected to each other. A screwed rod is longitudinally connected to the coupling and directed to the transparent such that the screwed rod can be driven by the drive unit. A screwed bushing is mounted on a front end of the seat, wherein the screwed rod screwed into and extending through the screwed bushing such that the coupling, the drive unit and the screwed rod are reciprocally moved relative to the rack due to a relation between the screwed rod and the screwed bushing when the screwed rod is rotated by the drive unit. A first claw is mounted on a free end of the screwed rod. Multiple driven devices are respectively mounted on the transparent panel and each partially received in a corresponding one of the rooms in the rack. Each driven device includes a bushing mounted on the transparent panel and a shaft extending through the bushing, wherein the shaft is rotatably and reciprocally moved relative to the bushing. The shaft includes a first end extending into the corresponding room for pushing the prize and a second end having a flexible element longitudinally mounted thereon, wherein the flexible element co-axially corresponds to the shaft when the flexible element is in a free condition. A second claw is mounted to a free end of the flexible element. The second claw is selectively rotated and pushed by the screwed rod when the drive unit is operated.

The method of operating the game machine in accordance with the present invention is different from that of the conventional suspensory game machine. The new play method of the present invention provides a novel amusing effect and enhances the difficult level of the cabinet-type game machine. Consequently, the purpose of attracting consumer is achieved.

Further benefits and advantages of the present invention will become apparent after a careful reading of the detailed description with appropriate reference to the accompanying drawings.

DETAILED DESCRIPTION OF THE INVENTION

Figure 1:
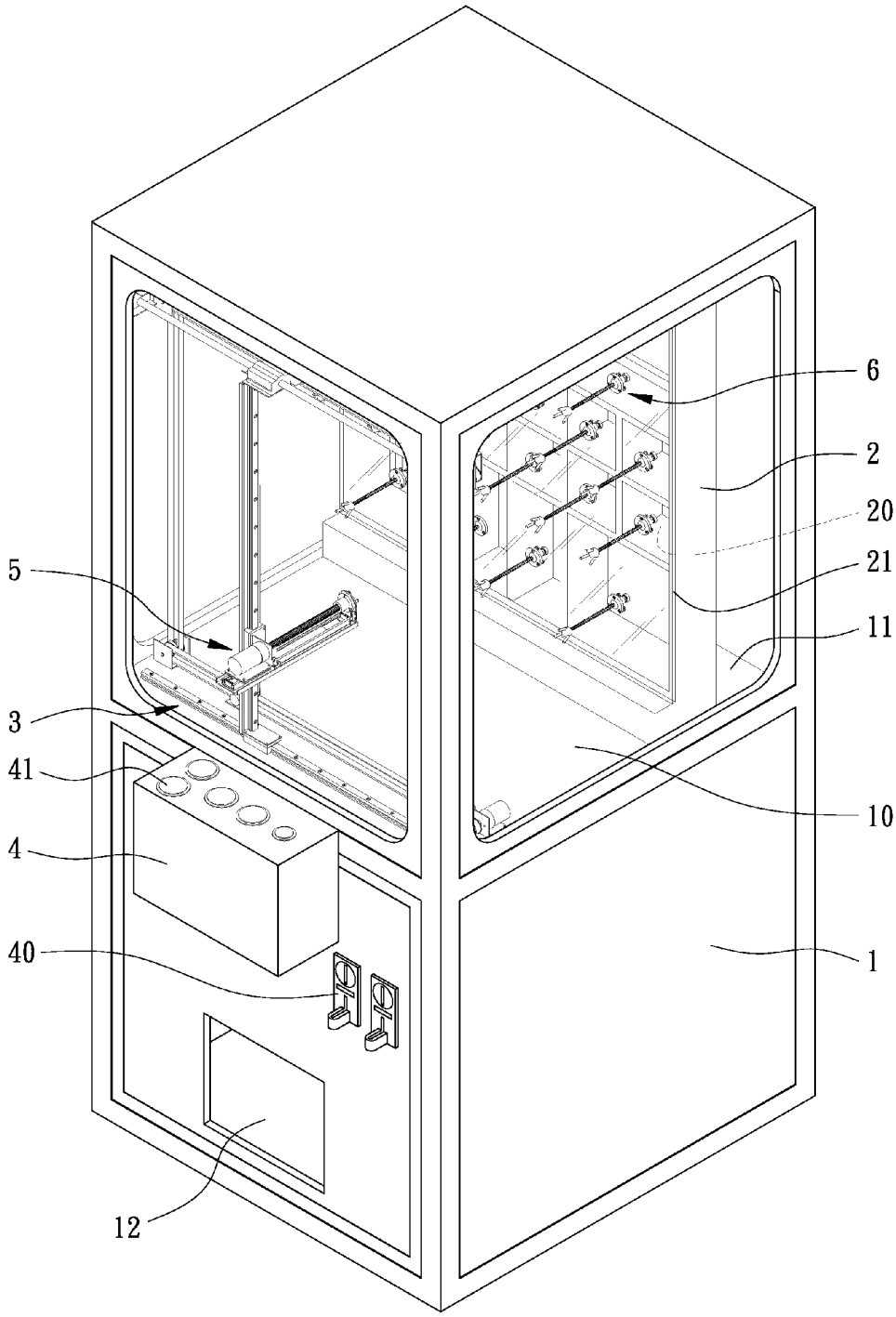
FIG. 1 is a perspective view of a game machine in accordance with the present invention.
Figure 2:
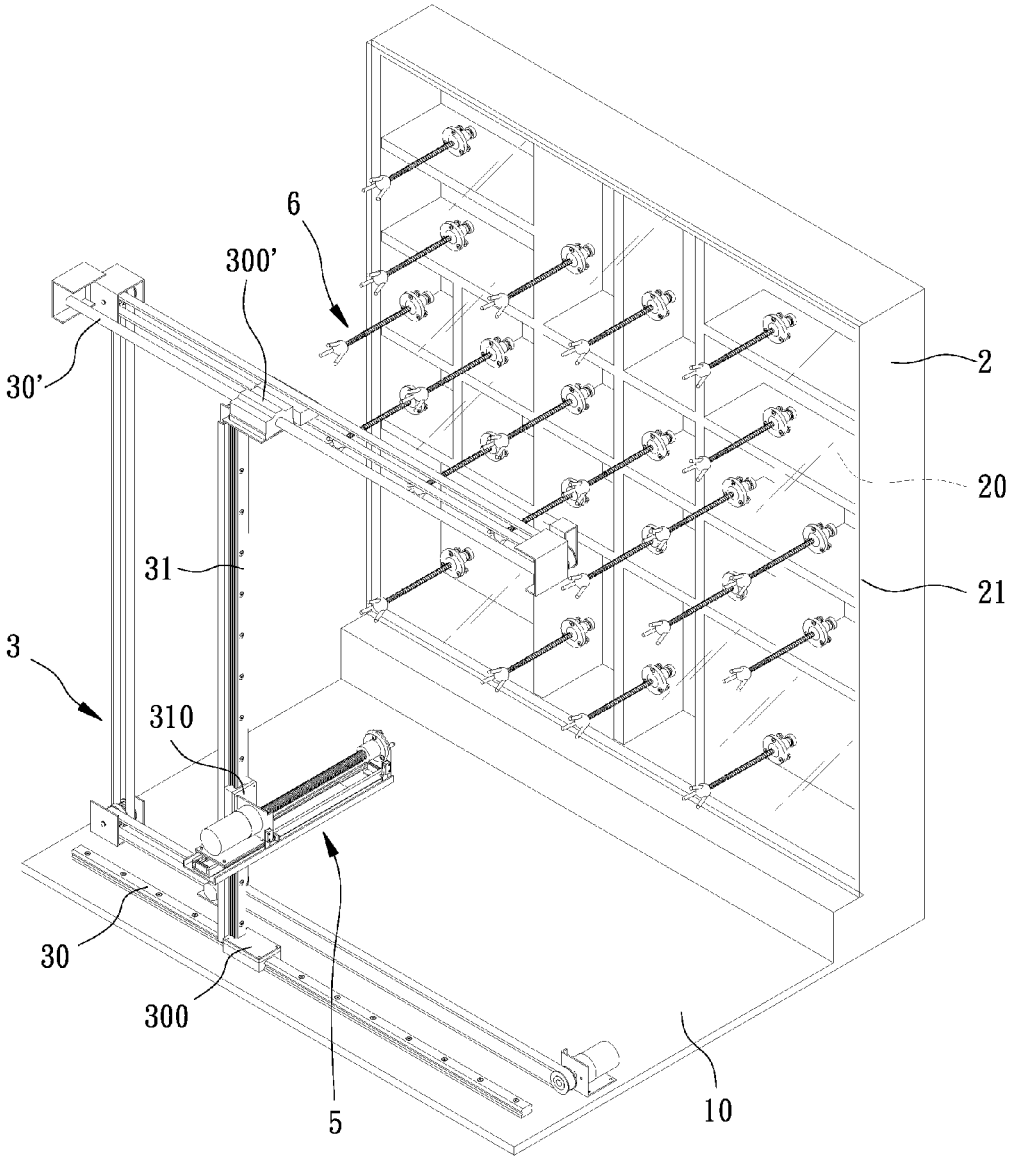
FIG. 2 is a partially perspective view of the game machine in accordance with the present invention.

Referring to the drawings and initially to FIG. 1 and FIG. 2, a game machine in accordance with the present invention comprises a cabinet-type main frame (1) standing on a supporting surface. A rack (2) and a movement assembly (3) are respectively disposed in the main frame (1). An operational unit (4) is mounted to a front panel of the main frame (1).

The main frame (1) includes a partition (10) horizontally secured in the main frame (1) for supporting the rack (2) and the movement assembly (3). A passage (11) is defined in the partition (10) behind the rack (2). A prize dispensing hole (12) is defined in the front panel of the main frame (1) and communicates with the passage (11).

The rack (2) is perpendicularly mounted on the partition (10) and includes multiple rooms (20) defined therein. A transparent panel (21) is attached to a front side of the rack (2) for closing all the rooms (20).

The movement assembly (3) includes a lower rail (30) mounted onto the partition (10) and an upper guide rod (30') mounted to the main frame (1), wherein the lower rain (30) and the upper guide rod (30') are parallel to each other and respectively correspond to an X-axis of the main frame (1). A first slider (300) and a second slider (300') are respectively slidably mounted on the lower rail (30) and the upper guide rod (30') and synchronously moved in a same direction when the movement assembly (3) is operated. A Z-axis rail (31) has two opposite ends respectively secured on the first slider (300) and the second slider (300'). A Z-axis slider (310) is slidably mounted on the Z-axis rail (31) and reciprocally moved along the Z-axis rail (31) when the movement assembly (3) is operated.

The operational unit (4) includes a slot (40) defined therein for player to insert coin(s) and multiple buttons (41) disposed thereon for player to operate game machine after inserting coin(s).

The movement assembly (3) further includes a drive device (5) mounted on the Z-axis slider (310) and multiple driven devices (6) mounted on the transparent panel (21), wherein each driven device (6) corresponds to a room (20) for pushing a prize received in the corresponding room (20).

Figure 3:
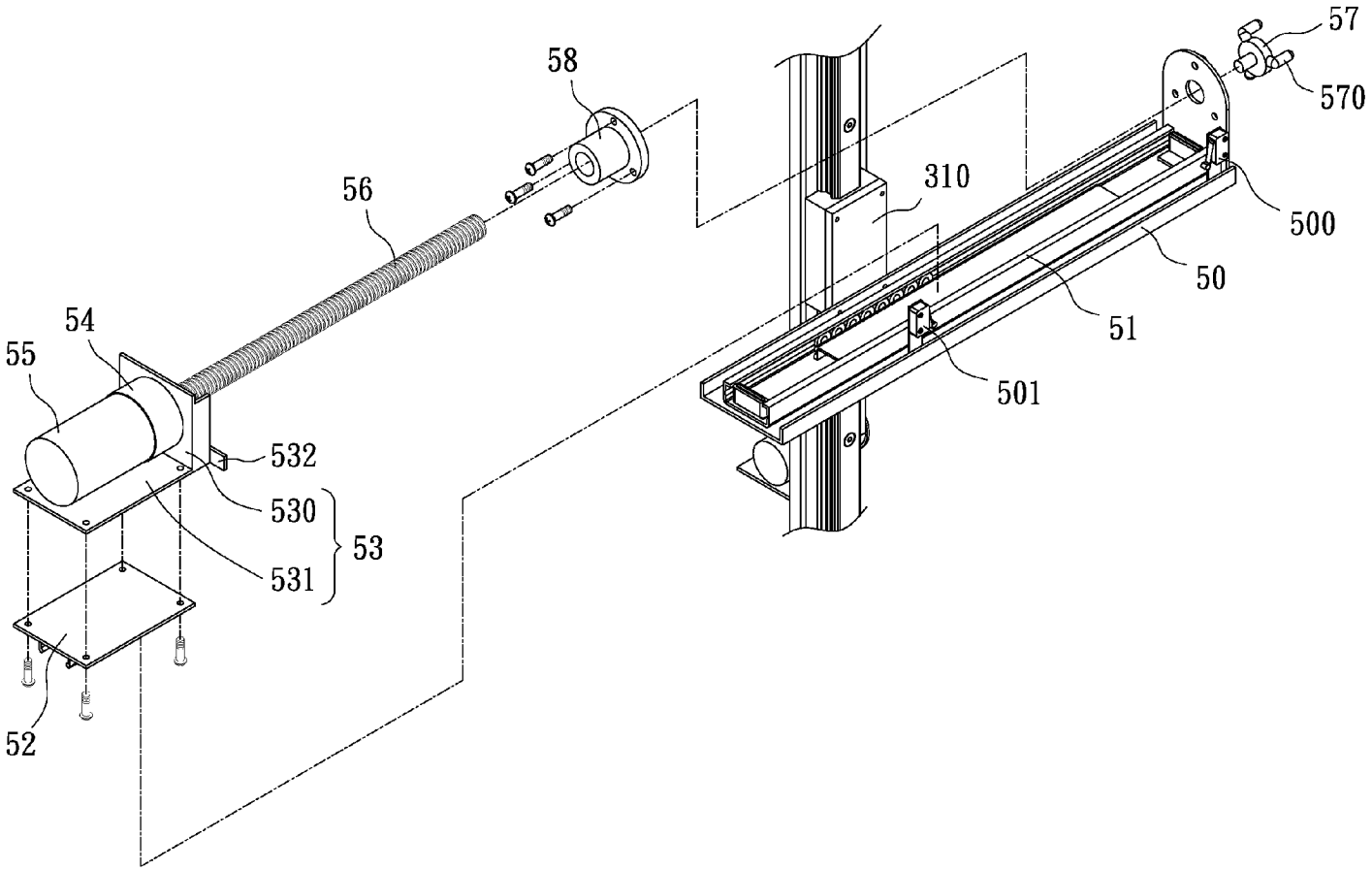
FIG. 3 is a partially exploded perspective view of a drive device of the game machine in FIG. 1.

With reference to FIG. 3, the drive device (5) includes a seat (50) laterally mounted to the Z-axis slider (310) and a pair of rails (51) longitudinally formed on the seat (50) along a Y-axis of the main frame (1). A slider (52) is slidably mounted on the pair of rails (51). An L-shaped seat (53) is secured on the slider (52) and divided into a vertical portion (530) and a horizontal portion (531). A coupling (54) is mounted on the vertical portion (530), and a drive unit (55) is mounted on the horizontal portion (531) and connected to the coupling (54). A screwed rod (56) is longitudinally connected to the coupling (54) such that the screwed rod (56) is driven by the drive unit (55). A screwed bushing (58) is mounted to a front end of the seat (50). The screwed rod (56) is screwed into and extends through the screwed bushing (58) such that the coupling (54), the drive unit (55) and the screwed rod (56) are moved along the Y-axis of the main frame (1), and the slider (52) and the L-shaped seat (53) is moved along the pair of rails (51) when the screwed rod (56) is rotated by the drive unit (55).

A first limit switch (500) and a second limit switch (501) are mounted on one side of the seat (50) and respectively correspond to the front end and a rear end of the seat (50). A protrusion (532) laterally extends from the L-shaped seat (53) and selectively abuts against the first limit switch (500)/the second limit switch (501). The first limit switch (500) sends a reverse signal to the drive unit (55) when the protrusion (532) abuts against the first limit switch (500) and the second limit switch (501) sends a stop signal to the drive unit (55) when the protrusion (532) abuts against the second limit switch (501).

Figure 4:
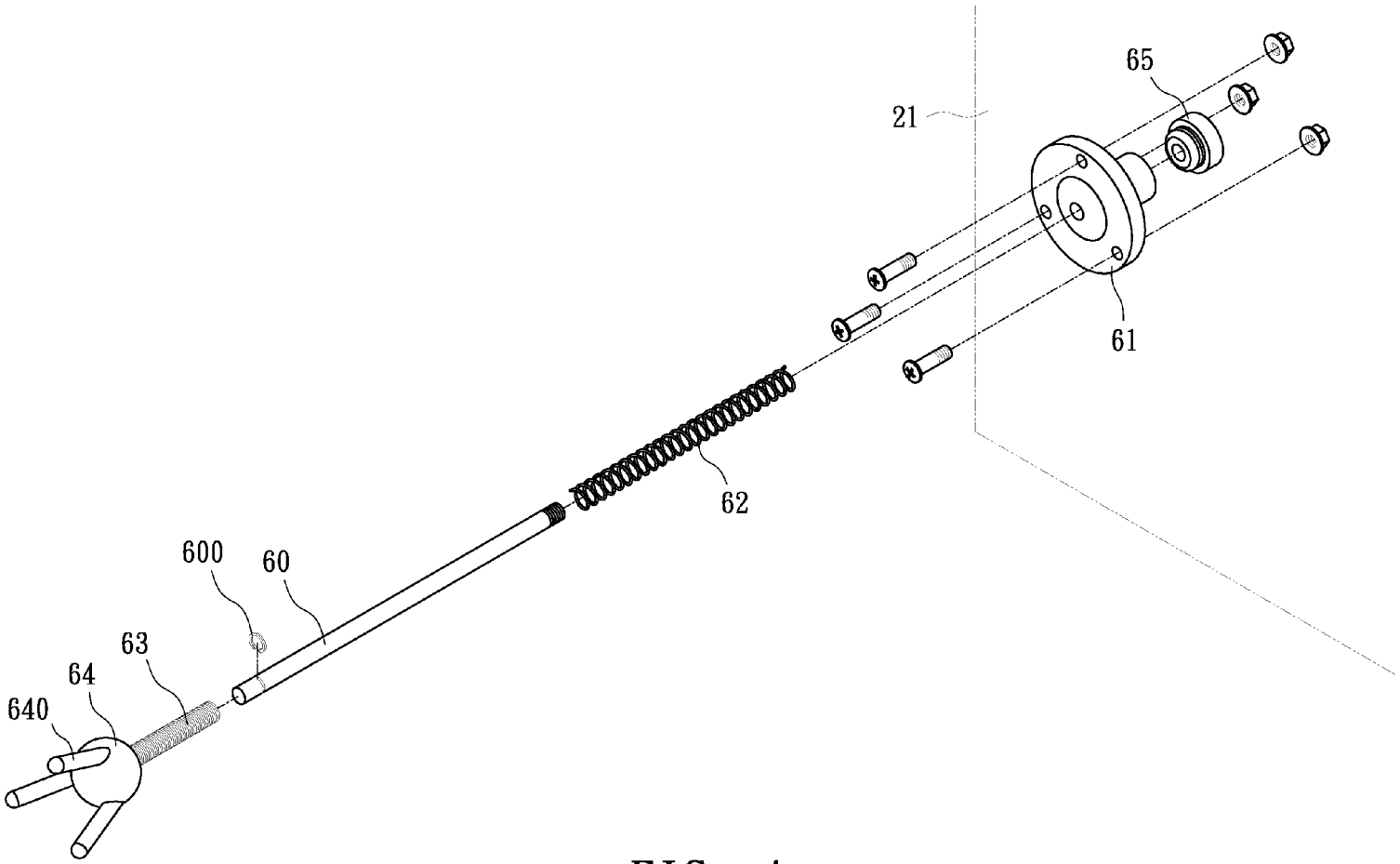
FIG. 4 is an exploded perspective view of a driven device of the game machine in FIG. 1.
Figure 5:
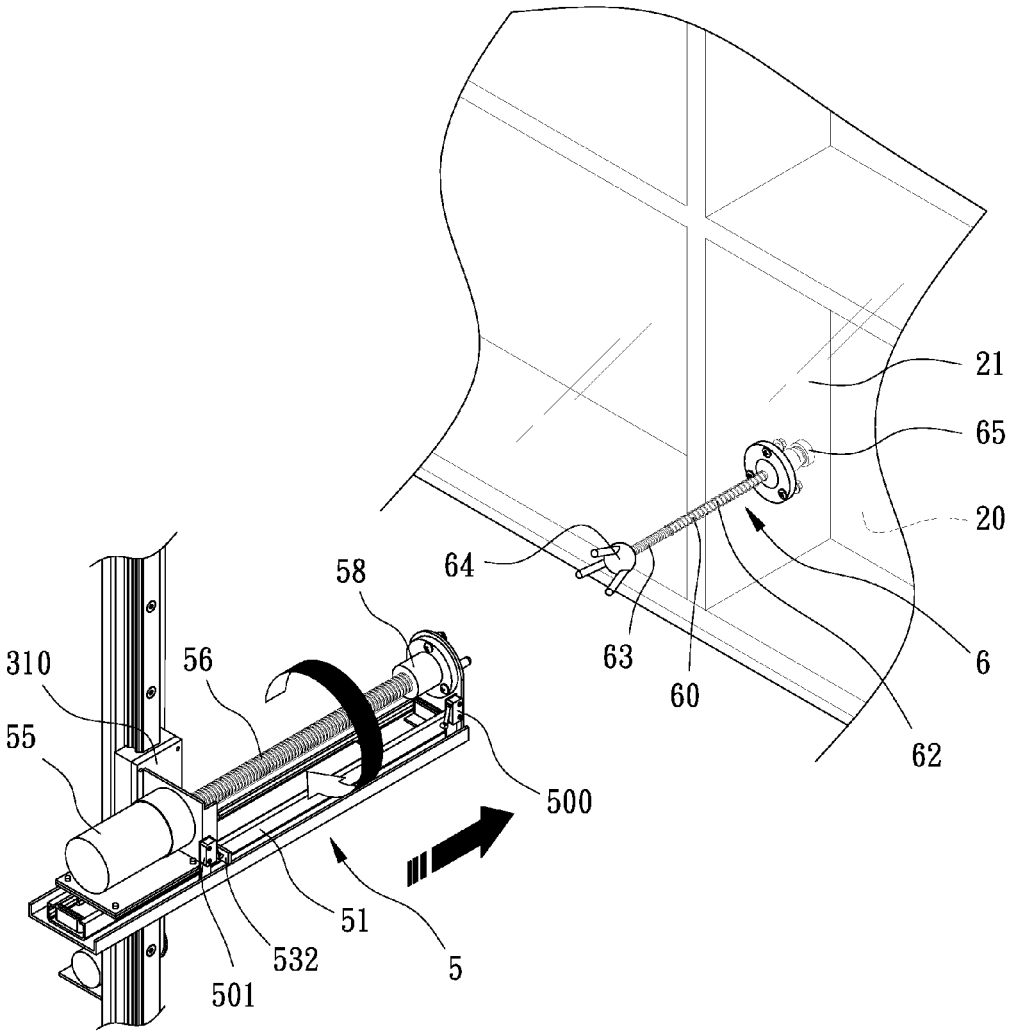
FIG. 5 is an operational view of the drive device when being obversely operated.
Figure 6:
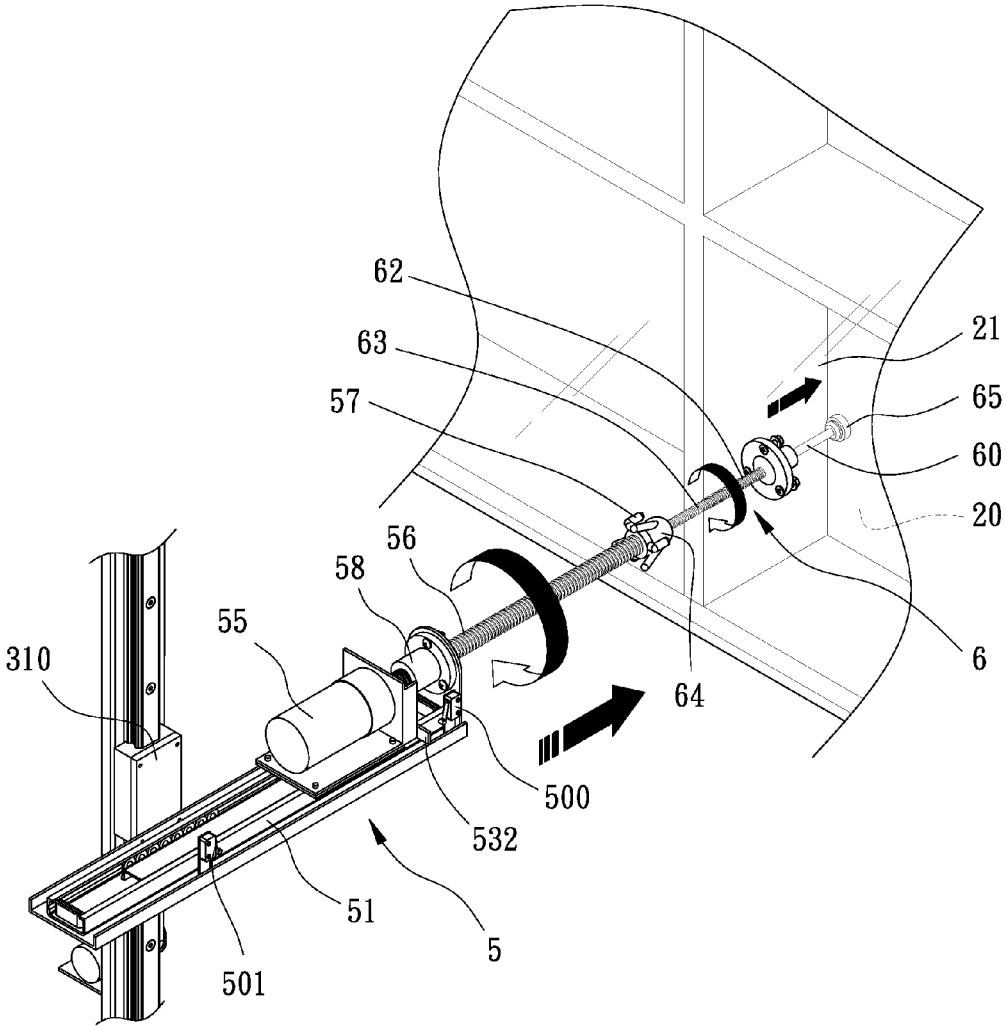
FIG. 6 is an operational view of the drive device and the driven device when being engaged to each other.
Figure 7:
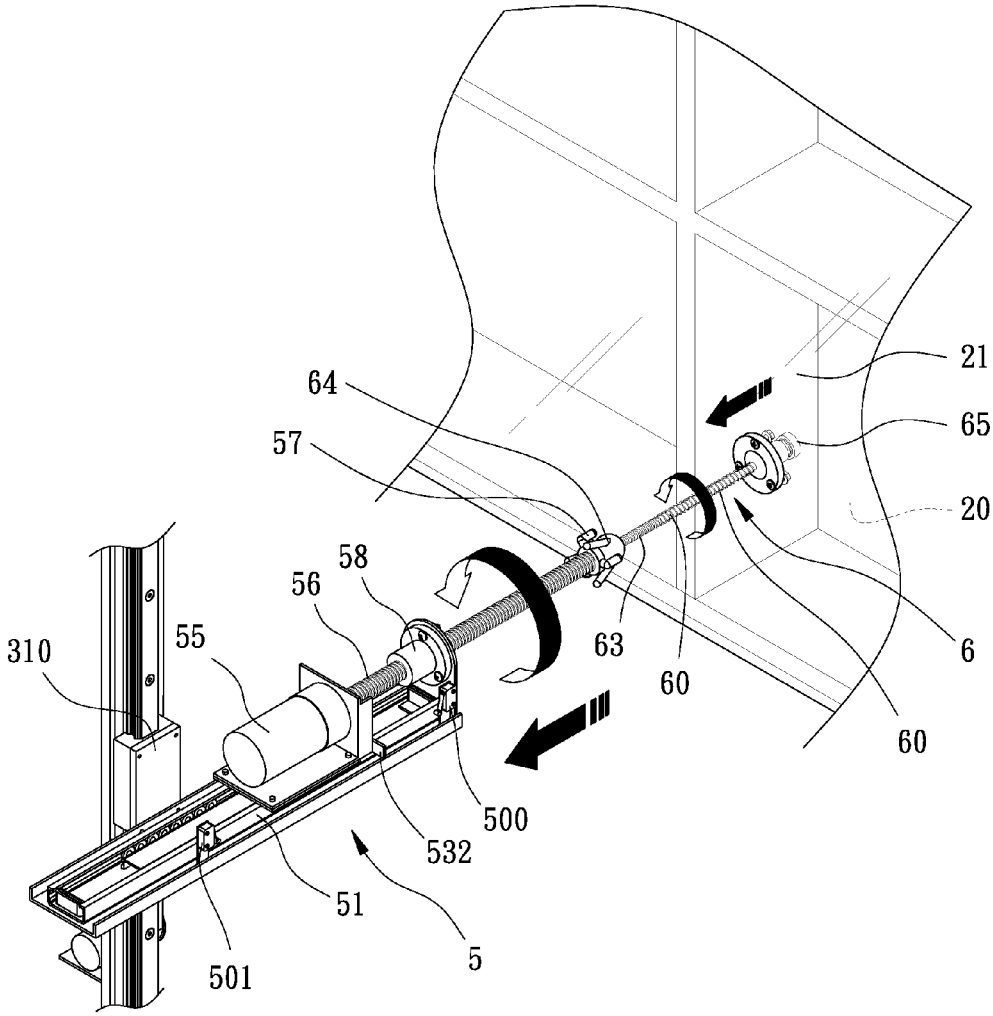
FIG. 7 is an operational view of the drive device when being reversely operated.

With reference to FIG. 4, each driven device (6) includes a bushing (61) mounted on the transparent panel (21) and a shaft (60) extending through the bushing (61). The shaft (60) is rotatably and reciprocally moved relative to the bushing (61). A stopper (600) is secured on the shaft (60) and a compressive spring (62) sleeved on the shaft (60), wherein the compressive spring (62) has two opposite ends respectively abutting against the bushing (61) and the stopper (600). The shaft (60) has a first end extending through the bushing (60) into the corresponding room (20) and having a end piece (65) mounted thereon for pushing the prize received in the corresponding room (20). The shaft (60) has a second end has a flexible element (63) longitudinally mounted thereon, wherein the flexible element (63) co-axially corresponds to the shaft (60) when the flexible element (63) is in a free condition. A second claw (64) is mounted to a free end of the flexible element (63) and has at least two stubs (640) radially extending therefrom, wherein the first claw (57) is selectively engaged to a corresponding one of the multiple second claws (64), which is mounted on a corresponding shaft (60) that is linearly aligned with the screwed rod (56). In the preferred embodiment of the present invention, the stopper (600) is a C-shaped ring and the flexible element (63) is a spring.

With reference to FIGS. 1-4 and FIGS. 5-7, the player can move the movement assembly (3) along a plane that is parallel to the transparent panel (21) via the operational unit (4). The drive unit (55) is operated to make the screwed rod (56) with the first claw (57) and the L-shaped seat (53) being moved toward the transparent panel (21) due to the relation between the screwed rod (56) and the screwed bushing (58) when the movement assembly (3) is moved to a purposed position and linearly aligns with a corresponding one of the shafts (60). The corresponding shaft (60) is rotated and pushed to the prize to make the prize being fallen into the prize dispensing hole (12) via the passage (11) when the first claw (57) engaged to the corresponding one of the second claws (64). However, the flexible element (63) is slanted when the screwed rod (56) does not linearly align with the shaft (60). As a result, the screwed rod (56) can not rotate and push the shaft (60).

As described above, the method of operating the game machine in accordance with the present invention is different from that of the conventional suspensory game machine. The new play method of the present invention provides a novel amusing effect and enhances the difficult level of the cabinet-type game machine. Consequently, the purpose of attracting consumer is achieved.

Although the invention has been explained in relation to its preferred embodiment, it is to be understood that many other possible modifications and variations can be made without departing from the spirit and scope of the invention as hereinafter claimed.

What is claimed is:

1. A game machine comprising:

a cabinet-type main frame standing on a supporting surface, the main frame including a partition horizontally secured therein, a passage defined in the partition, a prize dispensing hole defined in a front panel of the main frame and communicating with the passage;

a rack vertically mounted on the partition front of the passage, the rack having multiple rooms defined therein for receiving prizes and a transparent panel attached to a front side of the rack for closing the rooms;

a movement assembly mounted on the partition and a drive device mounted on the movement assembly, wherein the movement assembly drives the drive device along a plane that is parallel to the transparent panel, the drive device including a seat mounted on the movement assembly and a pair of rails formed on the seat toward the transparent panel, a slider slidably mounted on the pair of rails, a coupling and drive unit respectively mounted on the slider and connected to each other, a screwed rod longitudinally connected to the coupling and directed to the transparent panel such that the screwed rod can be driven by the drive unit, a screwed bushing mounted on a front end of the seat, wherein the screwed rod screwed into and extending through the screwed bushing such that the coupling, the drive unit and the screwed rod are reciprocally moved relative to the rack due to a relation between the screwed rod and the screwed bushing when the screwed rod is rotated by the drive unit, a first claw mounted on a free end of the screwed rod;

an operational unit mounted on a front panel of the main frame for user to control the movement assembly and the drive device; and multiple driven devices respectively mounted on the transparent panel and each partially received in a corresponding one of the rooms in the rack, each driven device including a bushing mounted on the transparent panel and a shaft extending through the bushing, wherein the shaft is rotatably and reciprocally moved relative to the bushing, the shaft including a first end extending into the corresponding room for pushing the prize and a second end having a flexible element longitudinally mounted thereon, wherein the flexible element co-axially corresponds to the shaft when the flexible element is in a free condition, a second claw mounted to a free end of the flexible element, the second claw selectively rotated and pushed by the screwed rod when the drive unit is operated.

2. The game machine as claimed in claim 1, wherein the driven device includes a stopper secured on the shaft and a compressive spring sleeved on the shaft, the compressive spring having two opposite ends respectively abutting against the stopper and the bushing.

3. The game machine as claimed in claim 2, wherein the drive device includes a first limit switch and a second limit switch mounted on one side of the seat and respectively corresponding to a front end and a rear end of the seat, the seat having a protrusion laterally extending therefrom and selectively abutting against the first limit switch and the second limit switch, wherein the first limit switch sends a reverse signal to the drive unit when the protrusion abuts against the first limit switch and the second limit switch sends a stop signal to the drive unit when the protrusion abuts against the second limit switch.

4. The game machine as claimed in claim 3, wherein the movement assembly includes a lower rail mounted onto the partition and an upper guide rod mounted to the main frame, wherein the lower rain and the upper guide rod are parallel to each other and respectively correspond to an X-axis of the main frame, a first slider and a second slider respectively slidably mounted on the lower rail and the upper guide rod and synchronously moved in a same direction when the movement assembly is operated, a Z-axis rail having two opposite ends respectively secured on the first slider and the second slider, a Z-axis slider slidably mounted on the Z-axis rail and reciprocally moved along the Z-axis rail when the movement assembly is operated.

5. The game machine as claimed in claim 4, wherein the seat is laterally mounted to the Z-axis slider.

6. The game machine as claimed in claim 2, wherein the movement assembly includes a lower rail mounted onto the partition and an upper guide rod mounted to the main frame, wherein the lower rain and the upper guide rod are parallel to each other and respectively correspond to an X-axis of the main frame, a first slider and a second slider respectively slidably mounted on the lower rail and the upper guide rod and synchronously moved in a same direction when the movement assembly is operated, a Z-axis rail having two opposite ends respectively secured on the first slider and the second slider, a Z-axis slider slidably mounted on the Z-axis rail and reciprocally moved along the Z-axis rail when the movement assembly is operated.

7. The game machine as claimed in claim 6, wherein the seat is laterally mounted to the Z-axis slider.

8. The game machine as claimed in claim 1, wherein the drive device includes a first limit switch and a second limit switch mounted on one side of the seat and respectively corresponding to a front end and a rear end of the seat, the seat having a protrusion laterally extending therefrom and selectively abutting against the first limit switch and the second limit switch, wherein the first limit switch sends a reverse signal to the drive unit when the protrusion abuts against the first limit switch and the second limit switch sends a stop signal to the drive unit when the protrusion abuts against the second limit switch.

9. The game machine as claimed in claim 8, wherein the movement assembly includes a lower rail mounted onto the partition and an upper guide rod mounted to the main frame, wherein the lower rain and the upper guide rod are parallel to each other and respectively correspond to an X-axis of the main frame, a first slider and a second slider respectively slidably mounted on the lower rail and the upper guide rod and synchronously moved in a same direction when the movement assembly is operated, a Z-axis rail having two opposite ends respectively secured on the first slider and the second slider, a Z-axis slider slidably mounted on the Z-axis rail and reciprocally moved along the Z-axis rail when the movement assembly is operated.

10. The game machine as claimed in claim 9, wherein the seat is laterally mounted to the Z-axis slider.

11. The game machine as claimed in claim 1, wherein the movement assembly includes a lower rail mounted onto the partition and an upper guide rod mounted to the main frame, wherein the lower rain and the upper guide rod are parallel to each other and respectively correspond to an X-axis of the main frame, a first slider and a second slider respectively slidably mounted on the lower rail and the upper guide rod and synchronously moved in a same direction when the movement assembly is operated, a Z-axis rail having two opposite ends respectively secured on the first slider and the second slider, a Z-axis slider slidably mounted on the Z-axis rail and reciprocally moved along the Z-axis rail when the movement assembly is operated.

12. The game machine as claimed in claim 11, wherein the seat is laterally mounted to the Z-axis slider.

* * * * *